US006227503B1

(12) United States Patent
Shiao Chen

(10) Patent No.: US 6,227,503 B1
(45) Date of Patent: May 8, 2001

(54) MECHANISM OF A GOLF BAG STAND

(76) Inventor: Shiu-Chen Shiao Chen, No. 14, Shih 1st Rd., Youth Ind. Park, Yangmei Chen, Taoyuan Hsien (TW)

( * ) Notice: Subject to any disclaimer, the term of this patent is extended or adjusted under 35 U.S.C. 154(b) by 0 days.

(21) Appl. No.: 09/353,013

(22) Filed: Jul. 13, 1999

(51) Int. Cl.[7] ..... A63B 55/00
(52) U.S. Cl. ..... 248/96; 206/315.7
(58) Field of Search ..... 248/96; 206/315.3, 206/315.7

(56) References Cited

U.S. PATENT DOCUMENTS 1,320,620 * 11/1919 Jenson ..... 248/96
5,048,777 * 9/1991 Quellais ..... 248/96
5,154,377 * 10/1992 Suk ..... 248/96
5,407,155 * 4/1995 Chung ..... 248/96
5,634,616 * 6/1997 Wang et al. ..... 248/96
5,662,296 * 9/1997 Wu ..... 248/96
5,829,719 * 11/1998 Han ..... 248/96
6,062,383 * 5/2000 Han ..... 206/315.7

FOREIGN PATENT DOCUMENTS

2278287 * 11/1994 (GB) ..... 248/96

* cited by examiner

*Primary Examiner*—Leslie A. Braun
*Assistant Examiner*—Jon Szumny
(74) *Attorney, Agent, or Firm*—Rosenberg, Klein & Lee

(57) ABSTRACT

A mechanism of a golf bag stand is disclosed. The mechanism has a pair of connecting seats spatially mounted on the golf bag and a pair of connectors each corresponding to and pivotally connected with one of the connecting seats. When the connecting seat and the connector are pivotal with respect to each other, stopping faces provided on both the connecting seat and the connector are able to provide substantial support to the golf bag, such that the golf bag stand will remain stable during the life span thereof.

2 Claims, 8 Drawing Sheets

MECHANISM OF A GOLF BAG STAND

BACKGROUND OF THE INVENTION

1. Field of the Invention

The invention relates to a mechanism of a golf bag stand, and more particularly to a mechanism, which is able to provide substantial support to the golf bag, such that the golf bag stands on the ground firmly.

2. Prior Art Description

Golfing has become one of the most popular pastimes. Therefore, various golf accessories are introduced into the market to make the golfer to have better performance on the course. One of the golf accessories is the golf bag which is designed to carry all kinds of clubs, so that the golfer is able to use all his/her focus on how to swing on the golf course without worrying about the load of the clubs. Referring to FIGS. 7 to 9, a conventional golf bag (60) is shown. The golf bag (60) has a skirt (61) securely mounted on top thereof, a mounting seat (62) securely attached to a periphery of the skirt (61), two legs (63) pivotally connected with the mounting seat (62), two connectors (64) each fixedly mounted on a corresponding leg (63), two linkages (65) each securely connected with a corresponding connector (64) and extending outward therefrom, a retainer (66) securely connected between the two linkages (65) and a pad (67) firmly attached to the free ends of the linkages (65). It is notable especially from FIGS. 7 and 8 that when the golf bag (60) is about to be rested on the ground, the pad (67) originally parallel to be the ground is forced to inclined with respect to the ground surface. The inclination of the pad (67) will thus drive the linkages (65) to accordingly pull out the legs (63). Therefore, the golf bag (60) is able to stand on the ground with the legs (63).

From the above description, it is concluded that the structure of the golf bag (60) suffers from the following drawback most.

Mounting Seat

As stated previously, all conventional golf bags have a mounting seat (62) securely attached to the skirt (61) by means of rivets or other suitable method. Because of the mounting seat (62), the retraction of the legs (63) is so limited that the legs (63) can not be securely stationed with respect to the golf bag. Furthermore, because of the skirt (61) and the mounting seat (62), the total weight of the golf bag increases, which burdens the golfers.

Weak Structure

It is known that both the legs (63) are pivotally connected with the mounting seat (62). There is no other support or strengthening device provided to the connection therebetween, such that the connection between the legs (63) and the mounting seat (62) will gradually become loose, which will cause difficulty to the transportation thereof, when being carried on the back of the golfer or a caddie.

Irreplaceable Parts

The skirt (61) is integrally formed with the golf bag (60) and the mounting seat (62) is securely attached on the periphery of the skirt (62), such that when the mounting seat (62) is damaged or the connection with the legs (63) is loose, the user will have to replace the entire golf bag (60) with a new one.

According to the above described drawbacks, the present invention aims to provide an improved golf bag to mitigate and/or obviate the shortcomings.

SUMMARY OF THE INVENTION

The main objective of the present invention is to provide a mechanism of a golf bag stand. The mechanism of the golf bag stand provides substantial support to the golf bag, such that the structure strength of the golf bag is increased and the loose connection between the legs and the golf bag is avoided.

In accordance with one aspect of the invention, the golf bag constructed in accordance with the present invention has a rim integrally formed on top of the golf bag, a pair of connecting seats spatially formed on the rim, a pair of connectors each pivotally connected to a corresponding connecting seat and having one leg securely connected therewith and an extension extending outward therefrom for connecting with one linkage, a limit connected between the two linkages and a pad securely connected with distal ends of the two linkages. With such an arrangement, the connectors are able to pivotally connect with one of the connecting seats. Therefore, the replacement of the defected parts is easily accomplished due to the pivotal connection between the connecting seat and the connectors. Furthermore, a first stopping face is formed on the connecting seat and a second stopping face is formed on the corresponding connector to be detachably against to the first stopping seat to provide a secure engage between the connecting seat and the connector. What's more is that to ensure the pivotal connection therebetween, the connecting seat has an arcuate cutout defined therein. The connector has a circular key formed to correspond to the arcuate cutout and an arcuate slot defined therein for receiving a lip formed between the first stopping face and the arcuate cutout. When the above mentioned structure is assembled, the pivotal connection between the connecting seat and the connector is secured.

The detailed features of the present invention will be apparent in the detailed description with appropriate reference to the accompanying drawings.

DETAILED DESCRIPTION OF THE PREFERRED EMBODIMENT

Figure 1:
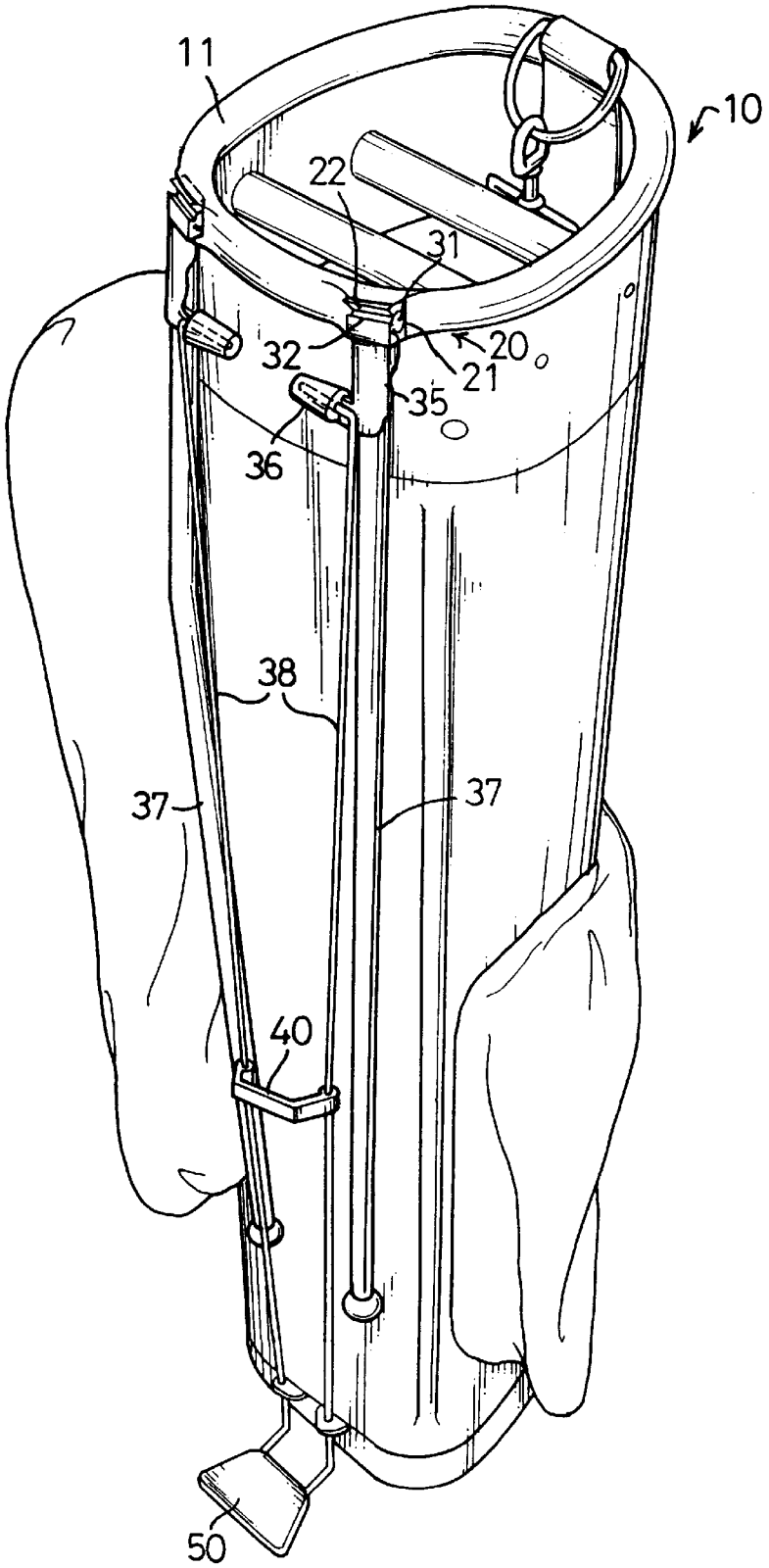
FIG. 1 is a perspective view showing the golf bag constructed in accordance with the present invention.
Figure 2:
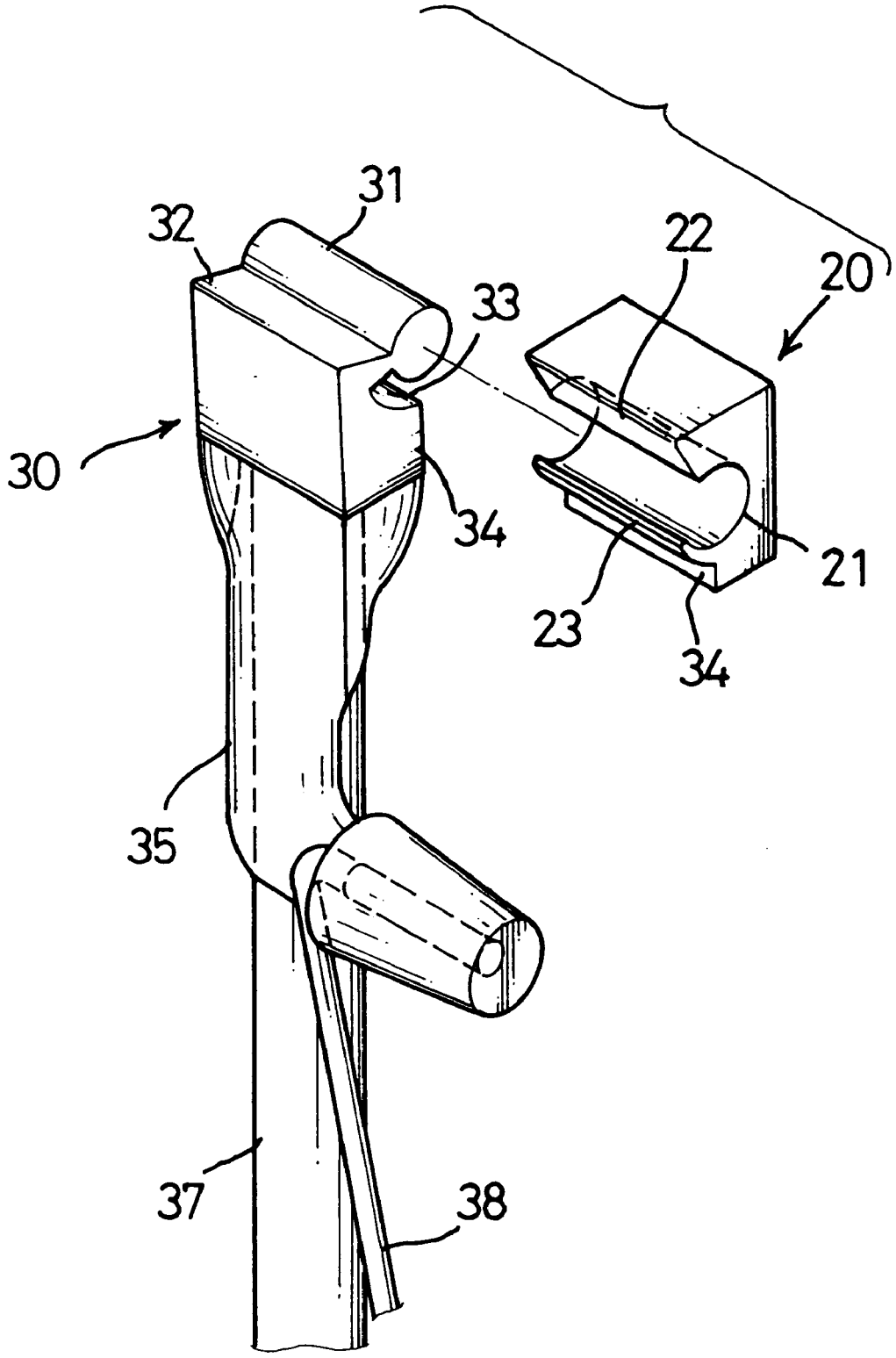
FIG. 2 is an exploded perspective view showing two parts used in the golf bag of FIG. 1 to secure the pivotal connection therebetween.

Referring to FIG. 1, a golf bag (10) constructed in accordance with the present invention is shown. The golf bag (10) has a rim (11) integrally formed on top of the golf bag (10), a pair of connecting seats (20) spatially formed on the rim (11), a pair of connectors (30) each pivotally connected to a corresponding connecting seat (20) and having one leg (37) securely connected therewith and an extension (35) extending outward therefrom for connecting with one linkage (38), a limit (40) connected between the two linkages (38) and a pad (50) securely connected with distal ends of the two linkages (38). Referring to FIG. 2, the connecting seat (20) has an arcuate cutout (21) defined therein, an inclined face (22) formed on top of the arcuate cutout (21), a first stopping face (24) formed below the arcuate cutout (21) and a lip (23) formed between the arcuate cutout (21) and the first stopping face (24). The connector (30) further has a circular key (31) integrally formed to be received in the arcuate cutout (21), an engaging face (32) formed to be detachably connected with the inclined face (22), an arcuate slot (33) defined to receive the lip (23) therein and a second stopping face (34) formed to correspond to the first stopping face (24).

Figure 3:
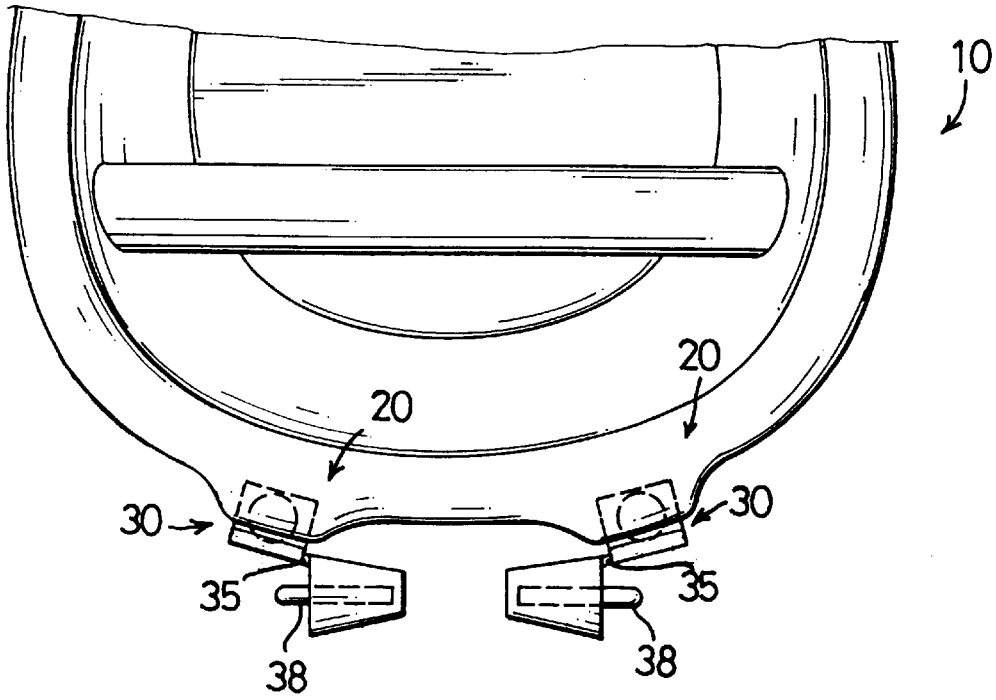
FIG. 3 is a top plan view showing the relative position between the connecting seat and the connector.
Figure 4:
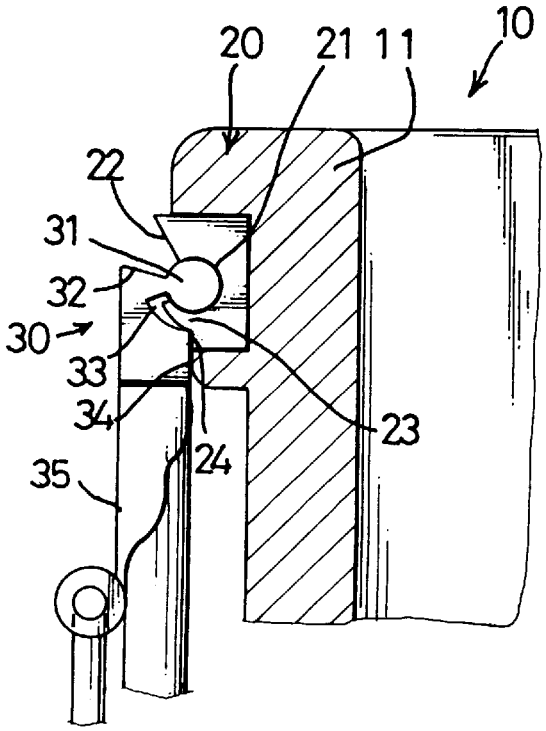
FIG. 4 is a partial cross sectional view showing the engagement between the connecting seat and the connector.

Referring to FIGS. 3 and 4, when the connecting seat (20) and the connector (30) are assembled, the circular key (31) is slid into the arcuate cutout (21). Meanwhile the lip (23) is slid into the arcuate slot (33). It is noted that when the golf bag (10) of the invention stands on the ground, the first stopping face (24) of the connecting seat (20) engages the second stopping face (34) of the connector (30). When the golf bag (10) is about to stand on the ground with the pair of legs (37), the inclination of the pad (50) will first pull the linkages (38) away from the golf bag (10). Then, the movement of the linkages (38) will drive the legs (37) to extend outward for the golf bag (10) to be ready for standing on the ground. While the legs (37) extend outward and the golf bag (10) inclines gradually, a pivotal movement between the connecting seat (20) and the connector (30) makes a separation between the lip (23) and the arcuate slot (33) and the first stopping face (24) with the second stopping face (34) and eventually allows the engagement between the inclined face (22) and the engaging face (32). Furthermore, referring to FIGS. 3 and 5, when the legs (37) of golf bag (10) are not driven by the inclination of the golf bag (10), both legs (37) are firmly secured with respect to the golf bag (10). When the golf bag (10) is oblique with respect to the ground, the driving of the pad (50) to the linkages (38) will also initiate the outward extension of the legs (37). That is because a relative angle exist between the extension (35) and the distal end of the linkage (38). It is noted from the drawings that when both legs (37) are not extended outward, the first stopping face (24) engages with the second stopping face (34) to limit the movement of the legs (37). When both legs (37) extend outward respect to the golf bag (10), a ten-degree (10°) relationship between the extension (35) and the distal end of the linkage (38) facilitates the outward extension and inward retraction of the legs (37).

Figure 5:
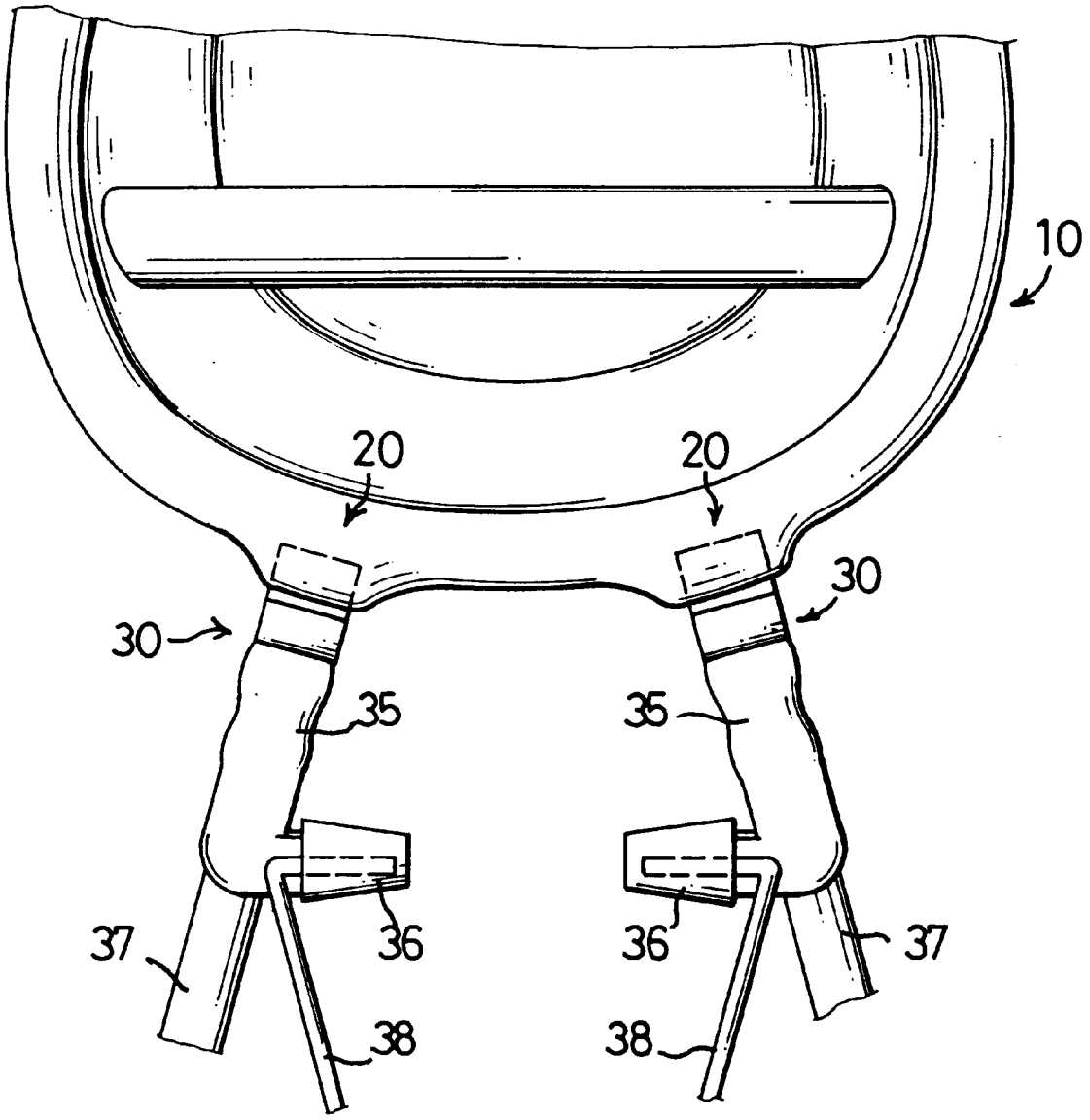
FIG. 5 is a top plan view showing the relative position between the connecting seat and the connector when they are stretched outward.
Figure 6:
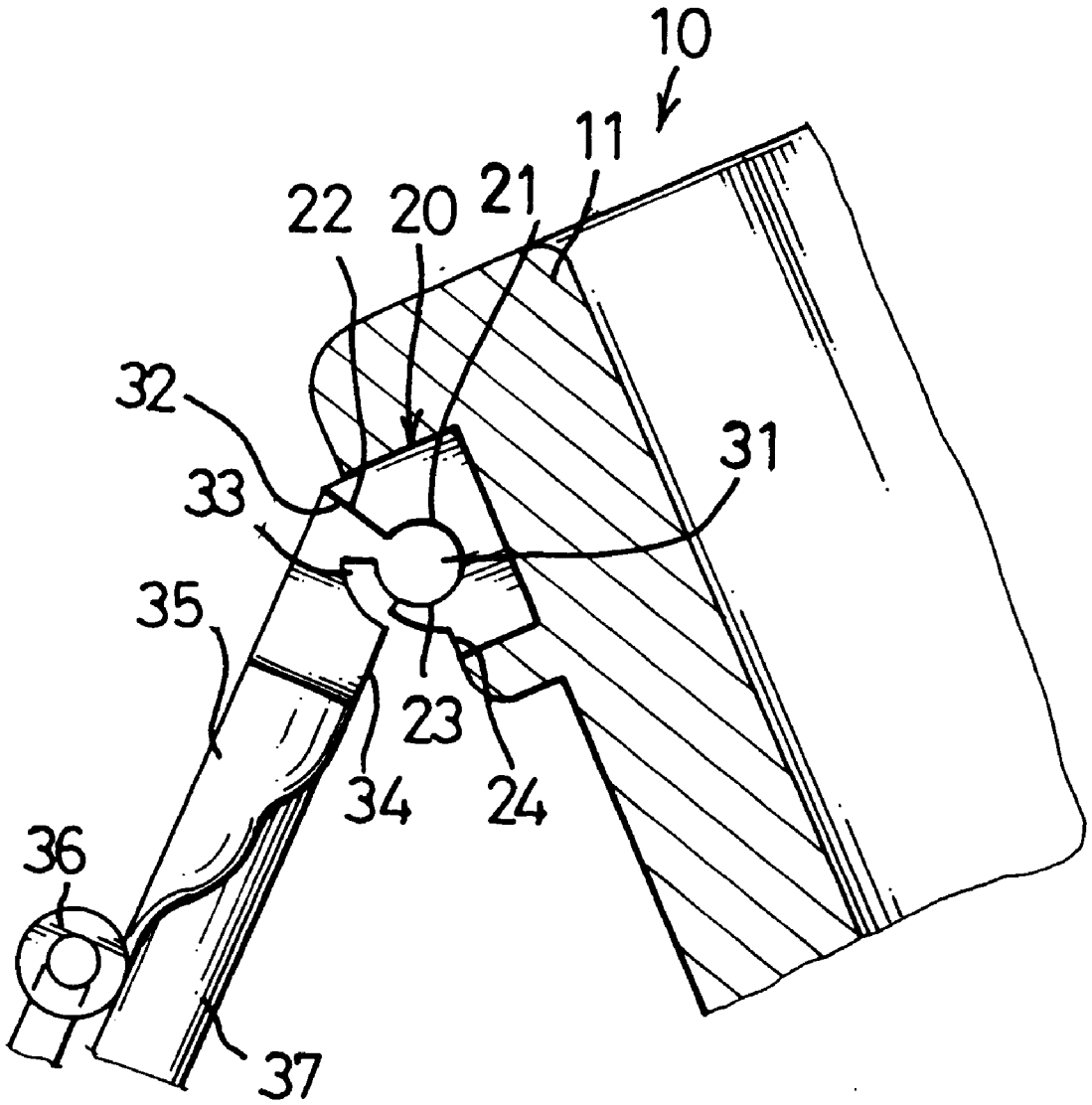
FIG. 6 is a side view showing the engagement between the connecting seat and the connector when they are stretched outward.
Figure 7:
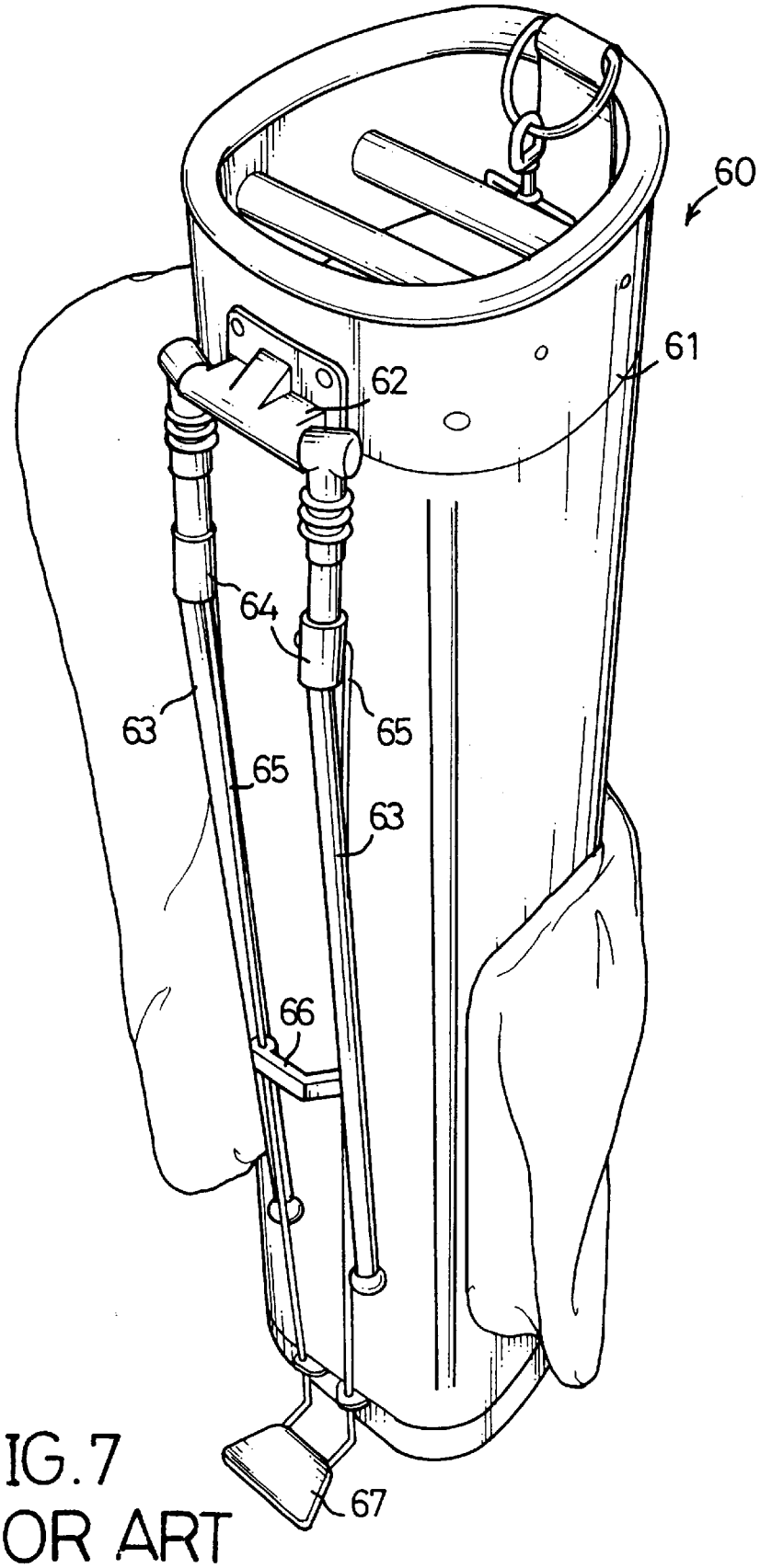
FIG.7 PRIOR ART
FIG. 7 is a perspective view showing a conventional golf bag.
Figure 8:
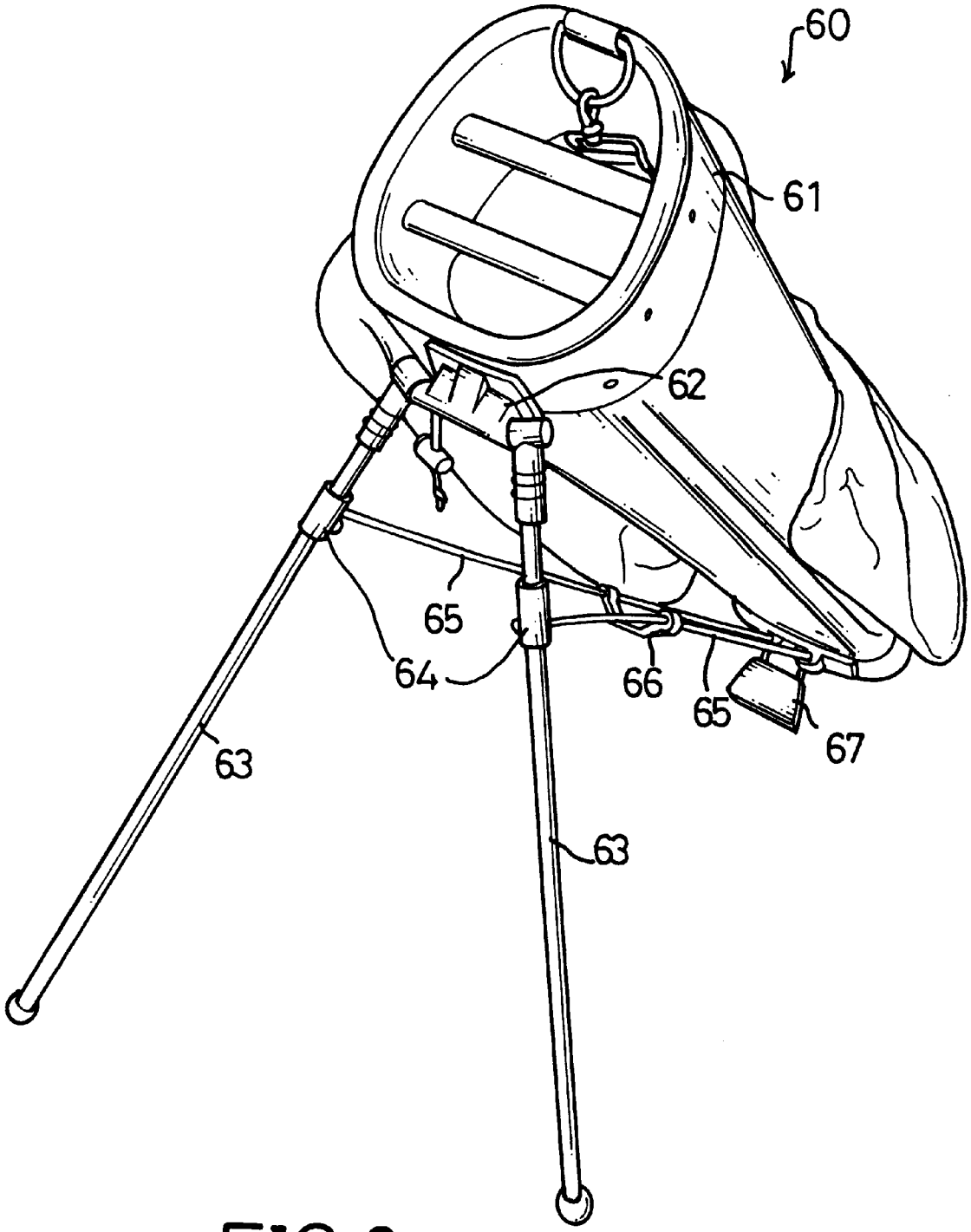
FIG.8 PRIOR ART
FIG. 8 is a perspective view showing the application of the golf bag shown in FIG. 7.
Figure 9:
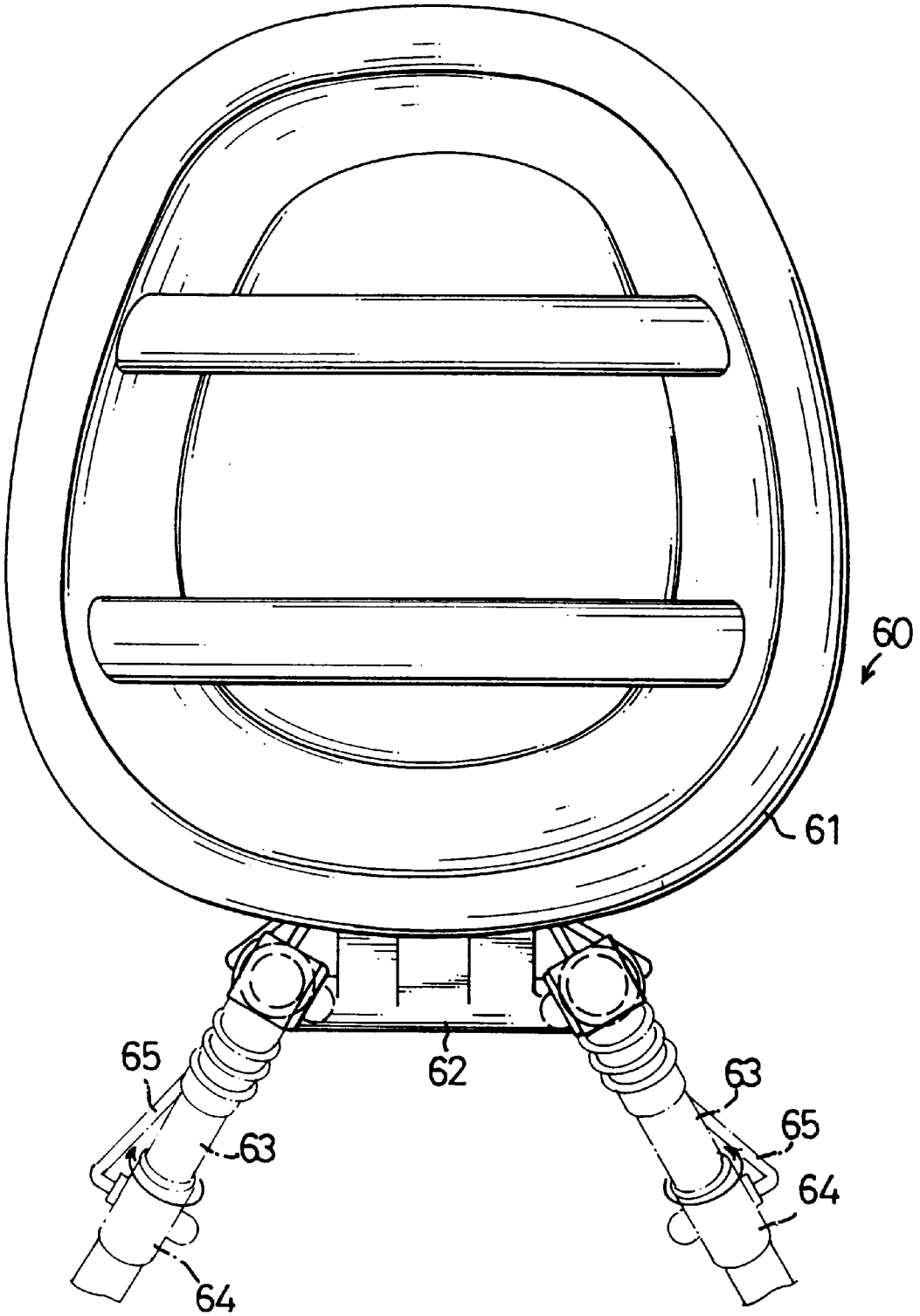
FIG. 9 PRIOR ART
FIG. 9 is a top plan view showing relative positions between the folded and stretched status as shown in FIG. 7.

It is noted from FIGS. 5 and 6 that when the golf bag (10) of the invention stands on the ground, the first stopping face (24) and the second stopping face (34) engage with each other. When the golf bag (10) is inclined toward the ground, the inclined face (22) engages with the engaging face (32). Therefore, the engagement between the first and second stopping faces (24,34) allows the golf bag (10) to be able to vertically stand on the ground firmly and the engagement between the inclined face (22) and the engaging face (32) allow the golf bag (10) to be able to inclinedly stand on the ground.

It is noted that the present invention has the following advantages:

1. Light Weight

Since the rim (11) is integrally formed with the golf bag (10) and there is no mounting seat required for engaging the legs (37), the overall weight of the golf bag (10) is greatly reduced.

2. Leg Stationed

Due to the relative angle between the extension (35) and the distal end of the linkage (38), when the legs (38) are retracted with respect to the golf bag (10), the legs (38) are firmly secured against the golf bag (10).

3. Better Appearance

Due to the elimination of the mounting seat and the integral formation of the skirt (61) with the golf bag (10), the golf bag (10) of the invention has a better overall appearance.

4. Better Support

The provision of the first and the second stop faces (24,34) provides a sound support to the golf bag (10) when the golf bag (10) is inclined with respect to the ground.

5. Replaceable Part

Because the connector (30) is inserted into the arcuate cutout (21) of the connecting seat (20), when either the connector (30) or the connecting seat is defected, the user is able to readily replace the defected part.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A stand mechanism for a golf bag, the stand mechanism comprising:

a rim (11) adapted to be integrally formed with the golf bag (10);

a pair of connecting seats (20) securely and spatially attached to the rim (11) and each having an arcuate cutout (21) defined therein, an inclined face (22) formed on top of the arcuate cutout (21) and a first stopping face (24) formed below the arcuate cutout (21); and a pair of connectors (30) each having a circular key (31) integrally formed therewith and pivotally received in one of the arcuate cutouts (21) and having an engaging face (32) detachably connected with the inclined face (22), a second stopping face (34) integrally formed to be detachably connected with the first stopping face (24), a leg (37) integrally formed therewith and extending outward therefrom and an extension (35) extending outward therefrom for connecting with a linkage (38);

wherein the connecting seat further has a lip (23) formed between the arcuate cutout (21) and the first stopping face (24) and the connector (30) has an arcuate slot (33) defined to receive the lip (23) therein.

2. The stand mechanism as claimed in claim 1, wherein a relative angle exists between the extension (35) and the distal end of the linkage (38) so as to facilitate the outward extension and inward retraction of the legs (37) with respect to the golf bag (10).

* * * * *